US007607382B2

(12) United States Patent
Wu

(10) Patent No.: US 7,607,382 B2
(45) Date of Patent: Oct. 27, 2009

(54) BICYCLE PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 273 days.

(21) Appl. No.: 11/782,722

(22) Filed: Jul. 25, 2007

(65) Prior Publication Data

US 2008/0014098 A1 Jan. 17, 2008

Related U.S. Application Data

(63) Continuation-in-part of application No. 11/039,726, filed on Jan. 19, 2005.

(51) Int. Cl.
*F15B 15/26* (2006.01)
*F04B 39/00* (2006.01)

(52) U.S. Cl. ..... 92/58.1; 417/234

(58) Field of Classification Search ..... 92/58.1; 417/234, 572

See application file for complete search history.

(56) References Cited

U.S. PATENT DOCUMENTS 758,516 A * 4/1904 Fisher ..... 92/58.1
867,616 A * 10/1907 Skinner ..... 417/258
1,623,647 A * 4/1927 Wepplo ..... 92/15
2,462,980 A * 3/1949 Litt ..... 92/58.1
2,557,139 A * 6/1951 Peters et al. ..... 92/58.1
5,433,136 A * 7/1995 Lung-Po ..... 92/58.1
5,494,411 A * 2/1996 Chuang ..... 92/58.1
5,551,848 A * 9/1996 Chuang et al. ..... 92/58.1
6,017,196 A * 1/2000 Wu ..... 417/234
6,250,205 B1 * 6/2001 Chuang ..... 92/15
6,464,477 B1 * 10/2002 Wu ..... 92/58.1
6,652,242 B2 * 11/2003 Wu ..... 417/63
6,736,619 B2 * 5/2004 Wu ..... 417/572
6,814,552 B2 * 11/2004 Wu ..... 417/440
7,404,703 B2 * 7/2008 Wang ..... 92/58.1

* cited by examiner

*Primary Examiner*—Thomas E Lazo
(74) *Attorney, Agent, or Firm*—Alan Kamrath; Kamrath & Associates PA

(57) ABSTRACT

A bicycle pump includes a cylindrical body in which a rod disposes. The rod is moveable inside the cylindrical body. A clip is attached to the outer peripheral surface of the cylindrical body. The clip includes a first clipping portion provided to allow insertion of the cylindrical body. The clip also has a second clipping portion defined on the periphery of the first clipping portion. A head is connected to the rod. The head also includes a hooking element thereon. A handle is pivotally connected to the head. A base is attached to the cylindrical body and includes a footstand on which the user can step to anchor the bicycle pump. The base also includes a hose. The hose has a length that is about twice as long as the cylindrical body. The hose is adapted be hanged by the hooking element and receivable by the second clipping portion.

11 Claims, 6 Drawing Sheets

BICYCLE PUMP

CROSS REFERENCE

The present application is a continuation-in-part application of U.S. patent application Ser. No. 11/039,726, filed on Jan. 19, 2005, of which the entire disclosure is incorporated herein.

BACKGROUND OF THE INVENTION

1. Field of the Invention

The present invention relates to bicycle pumps.

2. Description of the Related Art

Most known hand operated bicycle pumps fall into one of the two classes; floor pumps in which the body of the pump rests upon a ground, the pump generally has a footpeg on which the user can step to anchor the body of the pump for a stable pumping action. The floor pump also includes a hose that gives the user a greater margin of distance from the bicycle to thereby facilitate pumping operation; and frame pumps in which the body of the pump is light, and compact, so that the pump is portable and easily attachable to the bicycle frame. However, the problem of the floor pump is that it is difficult to be attached to the frame of the bicycle and the drawback of the frame pump is that it requires the user to hold and stabilize the body of the pump with one hand while the other hand carries out the pumping action all the time.

The present invention is, therefore, intended to obviate or at least alleviate the problems encountered in the prior art.

SUMMARY OF THE INVENTION

A bicycle pump includes a cylindrical body in which a rod disposes. The rod is moveable inside the cylindrical body and includes a portion exposed outside the cylindrical body.

A clip is attached to the outer peripheral surface of the cylindrical body. The clip includes a first clipping portion which is adapted for insertion of the cylindrical body. The clip also includes a pair of protrusions parallel to and spaced apart from each other. Each protrusion has a stepped fastening hole defined therein. A male fastening device and a female fastening device are received in the respectively stepped fastening hole such that the clip is firmly fixed on the cylindrical body. In addition, the clip has a second clipping portion defined on the periphery of the first clipping portion. The second clipping portion is substantially C-shaped.

A head is connected to the rod. Therefore, the head is moveable in the direction according to the movement of the rod. The head also includes a cavity extending longitudinally from an end thereof for receiving the rod. Furthermore, the head has a substantially conical shape and is configured to have a bottom that is coaxial to the cavity. The head also includes a hooking element and a tube formed thereon. Moreover, the tube has a through hole defined therein.

A handle is pivotally connected to the head. The handle is moveable between a first position where the head is in an alignment with the handle and a second position where the head is perpendicular to the handle. Furthermore, handle includes an open compartment for receiving the head when the head is in an alignment with the handle.

A base is attached to the cylindrical body and includes a footstand on which the user can step to anchor the bicycle pump for a stable pumping action. The base also includes a hose connected thereto. In addition, the hose is configured to have a length that is about twice as long as the cylindrical body for allowing the user to carry out the pumping operation conveniently, either with or without anchoring the bicycle pump to the ground. Furthermore, the hose is adapted be hanged by the hooking element at about the middle of its length and is adapted to be receivable by the second clipping portion.

It is an objective of this invention that it allows the user to carry out the pumping operation conveniently, either with or without anchoring the bicycle pump to the ground.

It is another objective of this invention that the hose is effectively restrained in place on the bicycle pump.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
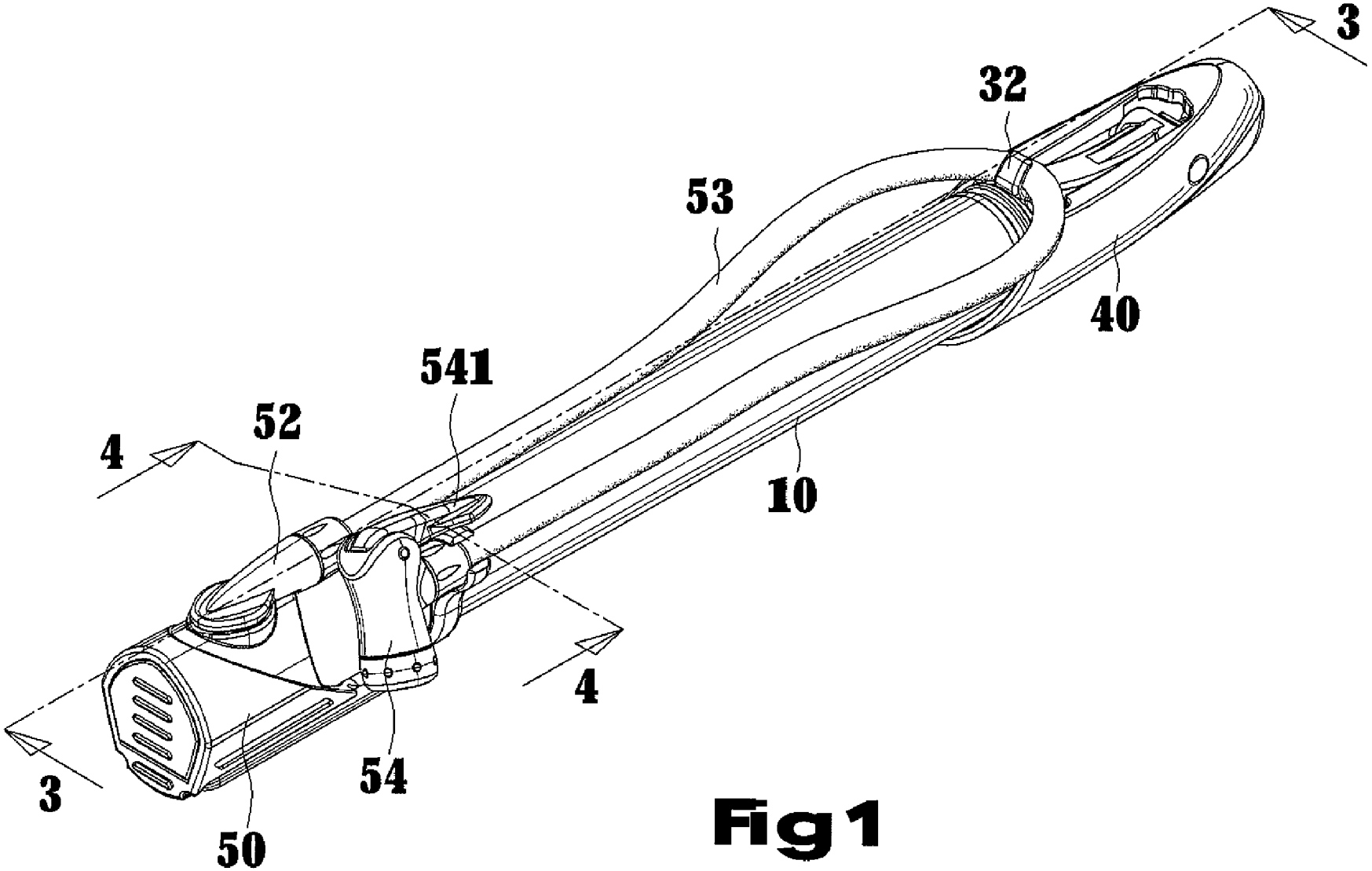
FIG. 1 is a perspective view of a bicycle pump in accordance with the present invention.
Figure 2:
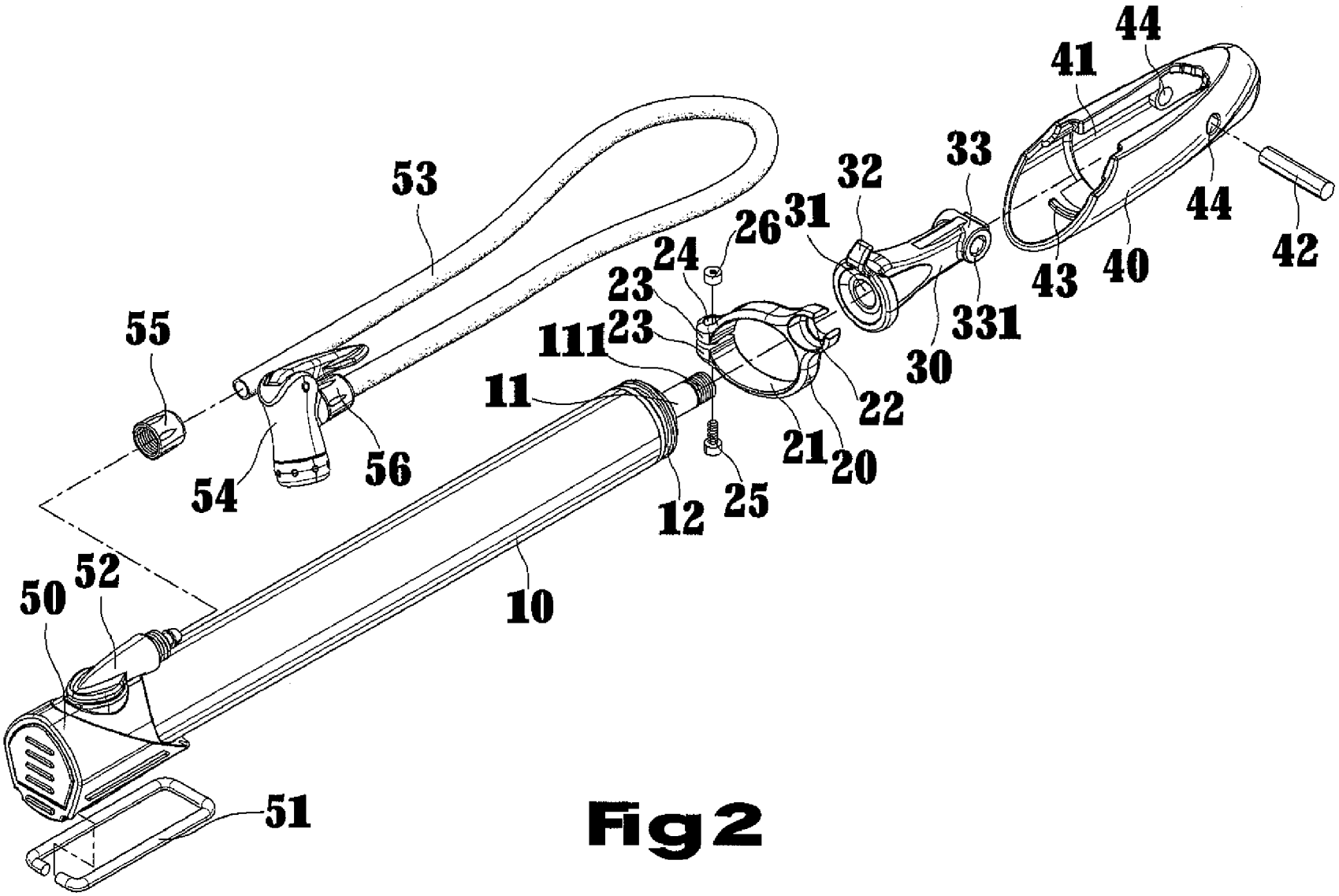
FIG. 2 is an exploded perspective view of FIG. 1.
Figure 3:
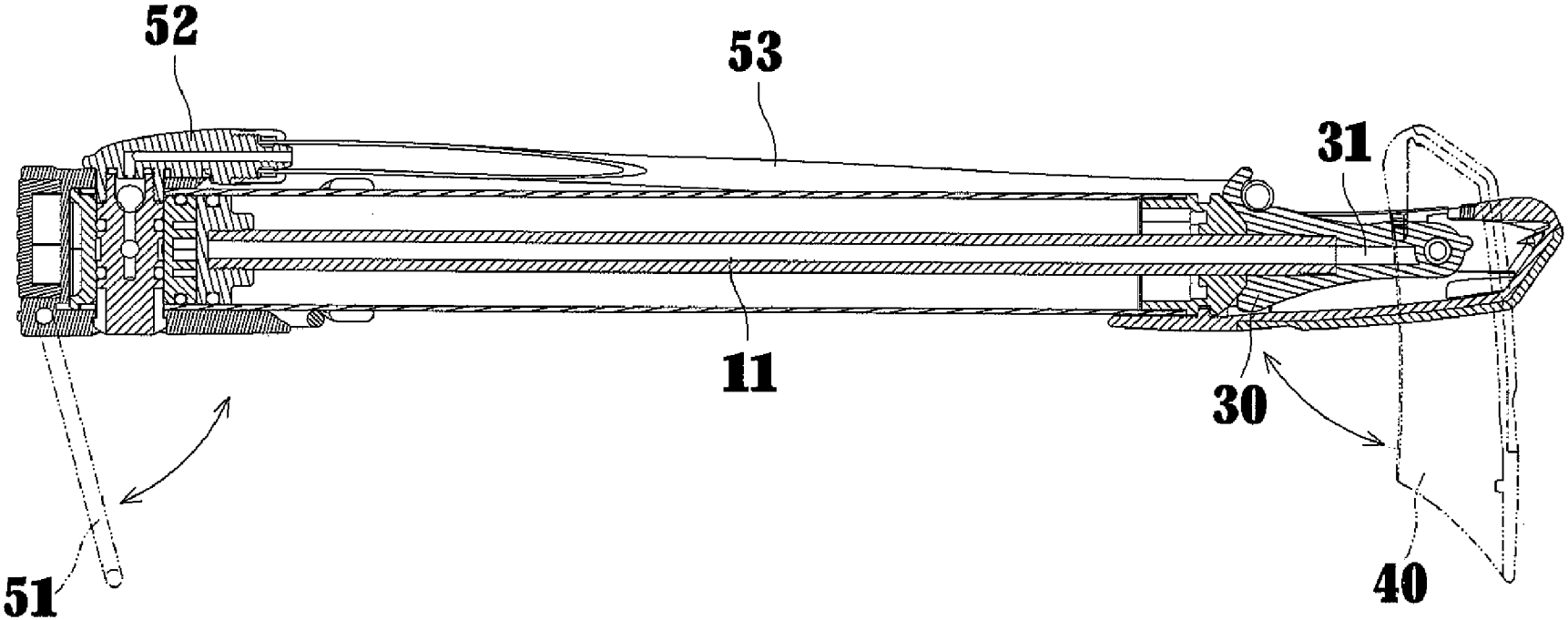
FIG. 3 is a cross-sectional view taken along line 3-3 of FIG. 1.
Figure 4:
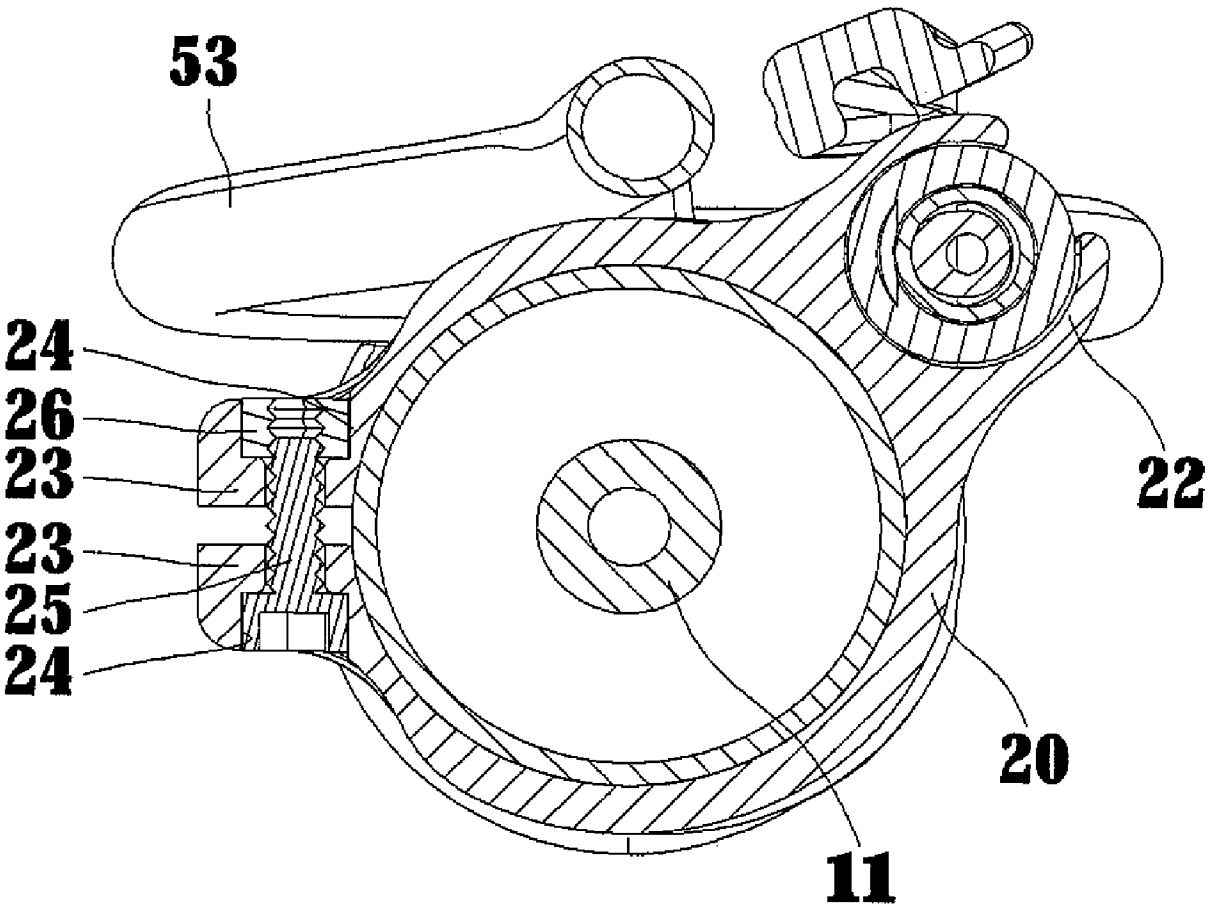
FIG. 4 is a cross-sectional view taken along line 4-4 of FIG. 1.

Referring to FIGS. 1 though 4, a bicycle pump includes a cylindrical body 10 in which a rod 11 disposes. The cylindrical body 10 includes a first end having an indentation 12 disposed about the outer peripheral surface of the cylindrical body 10 and a second end to which a base 50 attaches. The rod 11 is moveable inside the cylindrical body 10 and includes a portion exposed outside the first end of the cylindrical body 10. In addition, the portion has a threaded section 111 formed thereon for engaging with a head 30, which will be described further below.

A clip 20 is attached to the outer peripheral surface of the cylindrical body 10. The clip 20 includes a first clipping portion 21 which is adapted for insertion of the cylindrical body 10. In this embodiment, the clip 20 is disposed adjacent to where the base 50 is installed. The clip 20 also includes a pair of protrusions 23 parallel to and spaced apart from each other. Each protrusion 23 has a stepped fastening hole 24 defined therein. A male fastening device 25 and a female fastening device 26 are received in the respectively stepped fastening hole 24 such that the clip 20 is firmly fixed on the cylindrical body 10. In addition, the clip 20 has a second clipping portion 22 defined on the periphery of the first clipping portion 21. The second clipping portion 22 is substantially C-shaped.

As stated before, the head 30 is connected to the rod 11 via the threaded section 111 thereof. Therefore, the head 30 is moveable in the direction according to the movement of the rod 11. In the preferred embodiment of this invention, the head 30 includes a cavity 31 extending longitudinally from an end thereof for receiving the rod 11. The threaded section 111 of the rod 11 is adapted to restrain the rod 11 within the cavity 31. Furthermore, the head 30 has a substantially conical shape and is configured to have a bottom that is coaxial to the cavity

31. The head 30 also includes a hooking element 32 and a tube 33 formed thereon. Moreover, the tube 33 has a through hole 331 defined therein.

A handle 40 is pivotally connected to the head 30 by a pivot pin 42. The pivot pin 42 is adapted to insert through the handle 40 and the through hole 331 of the head 30. More specifically, the pivot pin 42 is inserted through two bores 44 disposed opposite to each other in a transverse direction. The pin 42 is inserted through one of the bores 44, then a through hole 331 of the tube 33, and another bore 412. As such, the handle 40 is moveable between a first position where the head 30 is in an alignment with the handle 40 and a second position where the head 30 is perpendicular to the handle 40. Furthermore, the handle 40 includes an open compartment 41 for receiving the head 30 when the head 30 is in an alignment with the handle 40. The handle 40 also includes a protuberance 43 receivable in the indentation 111 such that the handle 40 is attached to the cylindrical body 10 when the handle 40 is not pivoted with respect to the head 30.

The base 50 attached to the second end of the cylindrical body 10 includes a footstand 51 on which the user can step to anchor the bicycle pump for a stable pumping action. The base 50 also includes a connection head 52 pivotally connected thereto and a hose 53 connected to the connection head 52 via a first cap 55. The connection head 52 serves the purpose of allowing the compressed air from the cylindrical body 10 to flow into the hose 53. On the other end of the hose 53, the hose 53 is connected to a second nozzle head 54 via a second cap 56. The second nozzle head 54 is adapted to fit to a valve (not shown). In addition, the hose 53 is configured to have a length that is about twice as long as the cylindrical body 10 for allowing the user to carry out the pumping operation conveniently, either with or without anchoring the bicycle pump to the ground. Furthermore, the hose 53 is adapted be hanged by the hooking element 32 at about the middle of its length. The second cap 56 is adapted to be receivable by the second clipping portion 22.

Figure 5:
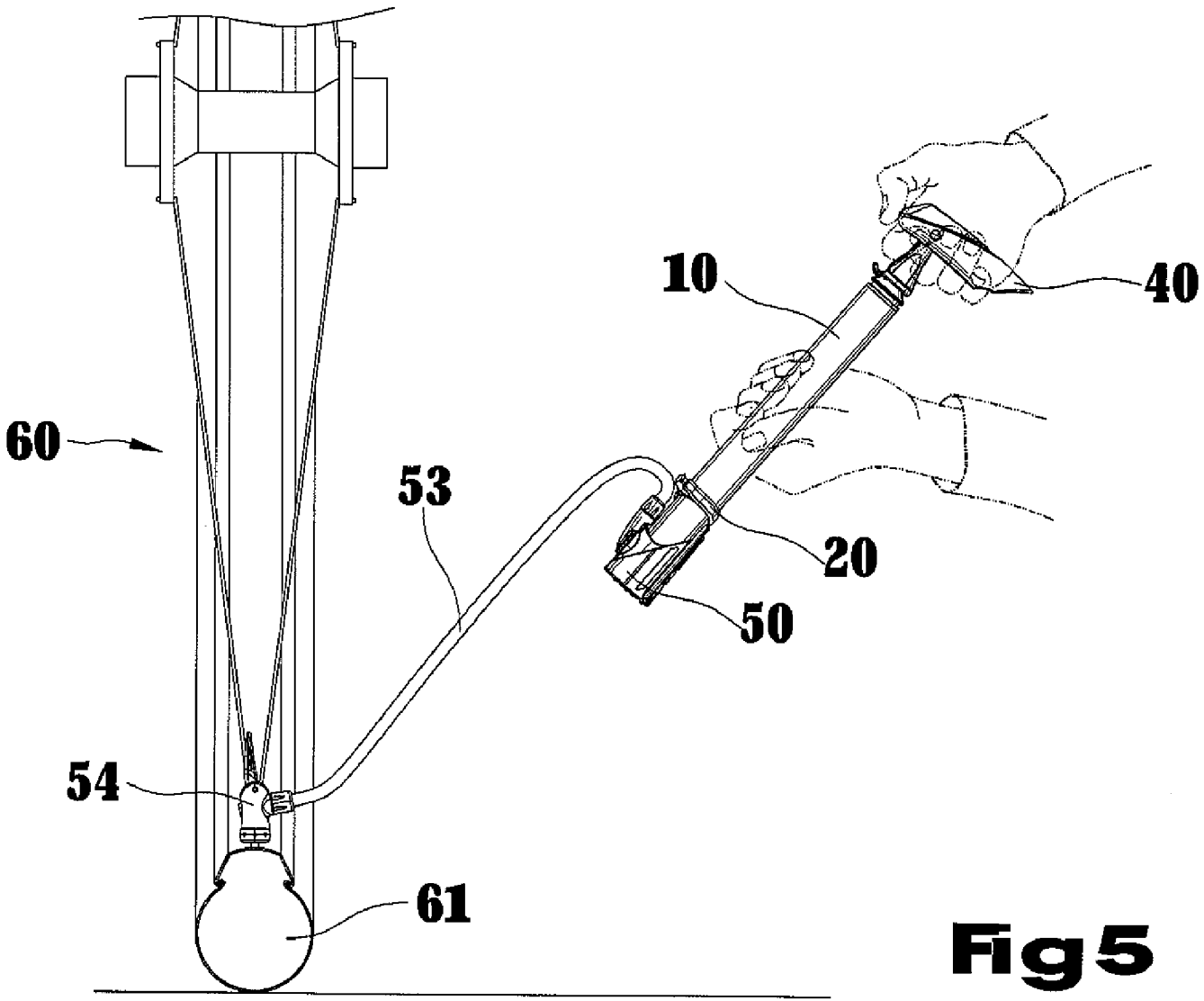
FIG. 5 is a diagrammatic representation illustrating the use of the bicycle pump shown in FIG. 1, with the operating hand shown in phantom.
Figure 6:
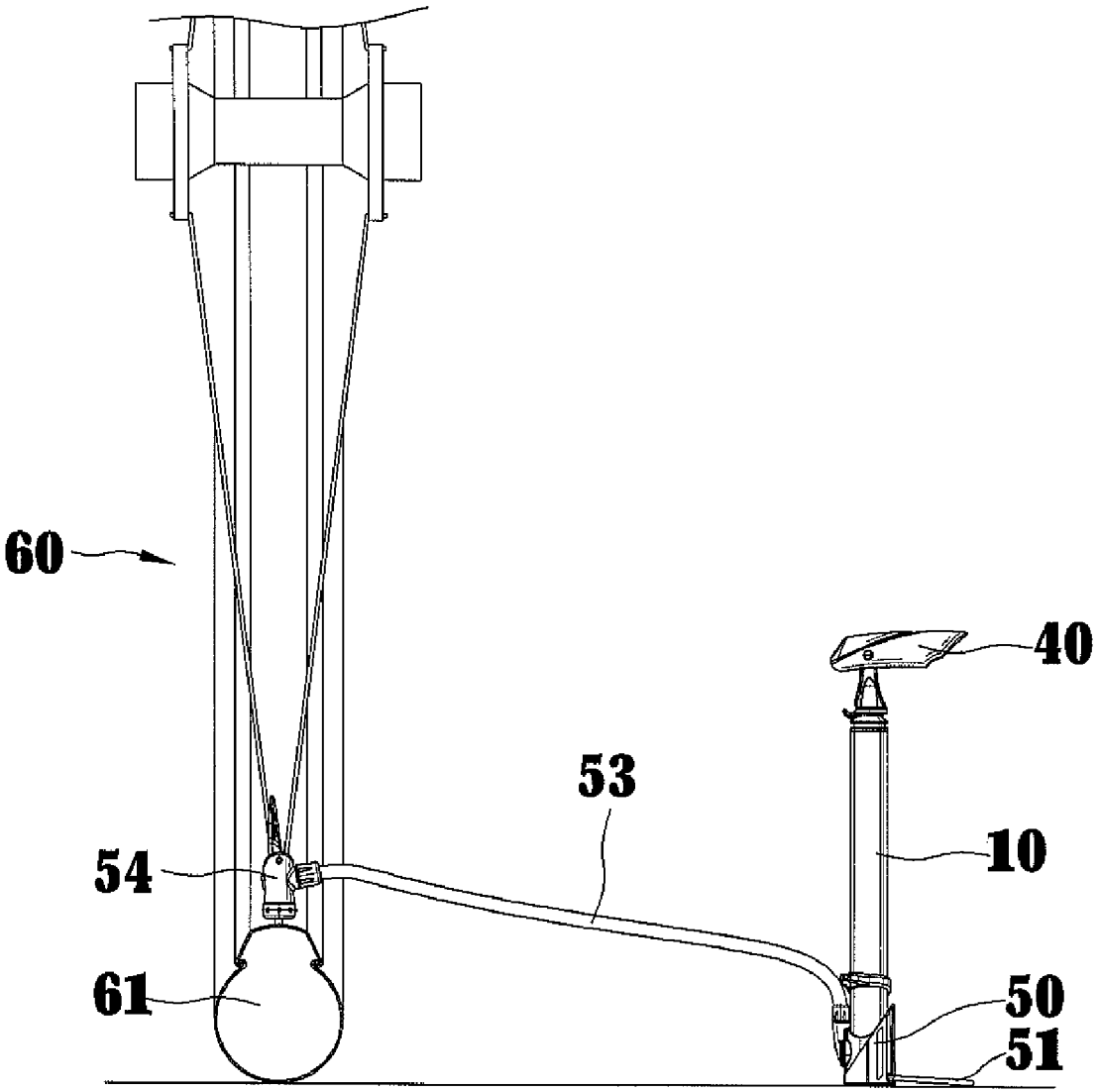
FIG. 6 is another diagrammatic representation illustrating the use of the bicycle pump shown in FIG. 1.

Referring to FIGS. 5 and 6, when the bicycle pump is used to inflate a tire 61 of a bicycle 60, the second cap 56 is disengaged from the second clipping portion 22, the hose 53 is released from the hooking element 32 and the handle 40 is pivoted to a second position where the handle 40 is perpendicular to the head 30.

Accordingly, this invention has an advantage that it allows the user to carry out the pumping operation conveniently, either with or without anchoring the bicycle pump to the ground.

Another advantage of this invention is that the hose 53 is effectively restrained in place on the bicycle pump.

While the specific embodiments have been illustrated and described, numerous modifications come to mind without significantly departing from the spirit of invention and the scope of invention is only limited by the scope of accompanying claims.

What is claimed is:

1. A bicycle pump comprising:

a cylindrical body including a rod disposed therein, with said rod being moveable inside said cylindrical body, and with said rod having a portion exposed outside said cylindrical body;

a clip including a first clipping portion engaged with outer peripheral surface of said cylindrical body and a second clipping portion on the periphery of the first clipping portion, and with said second clipping portion;

a head, with said head being threadly connected to said rod, and with said head including a hooking element formed thereon;

a handle pivotally connected to said head, with said handle having an open compartment, and with said head receivable in said open compartment; and a base connected to said cylindrical body, with said base including a hose attached thereto, with said hose being hanged at said hooking element at about the middle of its length, and with said hose receivable in said second clipping portion.

2. A bicycle pump as claimed in claim 1 wherein said hose has a length that is about twice as long as said cylindrical body.

3. A bicycle pump as claimed in claim 1 wherein said handle is moveable between a first position and a second position, wherein in said first position said head is in an alignment with said handle, and in said second position said head is perpendicular to said handle.

4. A bicycle pump as claimed in claim 3 wherein said handle includes a protuberance defined thereof, said first end of said cylindrical body includes an indentation disposed about the peripheral surface thereof, and said protuberance is receivable in said indentation when said handle is in the first position.

5. A bicycle pump as claimed in claim 1 wherein said base includes a footstand on which the user can step to anchor the pump for stable pumping action.

6. A bicycle pump as claimed in claim 1 wherein said head includes a cavity disposed therein, with said cavity extending longitudinally from an end thereof for receiving said rod.

7. A bicycle pump as claimed in claim 6 wherein said head is configured to have a bottom that is coaxial to the cavity.

8. A bicycle pump as claimed in claim 6 wherein said head includes a tube, with said handle pivotably connecting to said head at said tube.

9. A bicycle pump as claimed in claim 1 wherein said second clipping portion is substantially C-shaped.

10. A bicycle pump as claimed in claim 1 wherein said head has a substantially conical shape.

11. A bicycle pump as claimed in claim 1 wherein the base includes a pivotally connection head, with said hose being attached to the connection head.

* * * * *